US005105939A

United States Patent [19]

Ralston, Jr.

[11] Patent Number: 5,105,939

[45] Date of Patent: Apr. 21, 1992

[54] COMBINED RETAIL PACKAGE AND CARRYING CASE

[75] Inventor: Robert T. Ralston, Jr., Guilford, Conn.

[73] Assignee: Conair Corporation, Stamford, Conn.

[21] Appl. No.: 663,565

[22] Filed: Mar. 4, 1991

[51] Int. Cl.[5] ..... B65D 25/54

[52] U.S. Cl. ..... 206/45.34; 206/462; 206/468

[58] Field of Search ..... 206/461–471, 206/45.31, 45.34; 220/662

[56] References Cited

U.S. PATENT DOCUMENTS

| | | | |
|---|---|---|---|
| 2,637,482 | 5/1953 | Broderick | 206/45.31 |
| 2,945,583 | 7/1960 | Sire | 206/45.34 |
| 3,608,705 | 9/1971 | Moshel | 206/45.31 |
| 4,180,165 | 12/1979 | Kuchenbecker | 206/45.31 |

FOREIGN PATENT DOCUMENTS

| | | | |
|---|---|---|---|
| 0417175 | 9/1934 | United Kingdom | 206/45.31 |
| 2030111 | 4/1980 | United Kingdom | 206/461 |

*Primary Examiner*—Jimmy G. Foster
*Attorney, Agent, or Firm*—Haynes N. Johnson

[57] ABSTRACT

A retail display formed of a display card and a transparent carrying case and having peripheral indentations along opposing ends of the case, the peripheral indentations having locking edges facing their respective ends of the case, the display card including a pair of sleeves, the periphery of the sleeves conforming in size and shape to the periphery of the carrying case, at least one locking member in each sleeve with the locking members being positioned to oppose their respective locking edges, and the interengagement of the locking edges and the locking members securing the carrying case within the sleeves.

13 Claims, 2 Drawing Sheets

COMBINED RETAIL PACKAGE AND CARRYING CASE

FIELD OF THE INVENTION

My invention relates to the field of packaging products for retail display and sale. In particular, it relates to a pilferproof display card which holds a carrying case for a product, such as a personal care appliance, and displays the product.

BACKGROUND OF THE INVENTION

When packaging products for retail display, it is desirable to have a display window in the package to show the product, or to form a blister over the product so that it can be seen, but not readily stolen. This packaging is wasteful in that it is promptly thrown away by the purchaser. My package uses a permanent, transparent carrying case to hold and display the product and yet is formed into an attractive retail display which holds the carrying case.

BRIEF SUMMARY OF THE INVENTION

A transparent blow-molded case carries the product being displayed, which product could be, for example, a curling iron. The case, which has a slidingly removable top, is carried at its two ends by sleeves forming part of a display card. The outer ends of the sleeves have been folded inwardly to form locking flanges which press against an indented area at each end of the carrying case. The flanges in the left sleeve prevent moving the case to the left; and the flanges in the right sleeve prevent moving the case to the right. This makes it almost impossible to remove the case from the card without destroying the card.

DETAILED DESCRIPTION OF THE INVENTION

Figure 1:
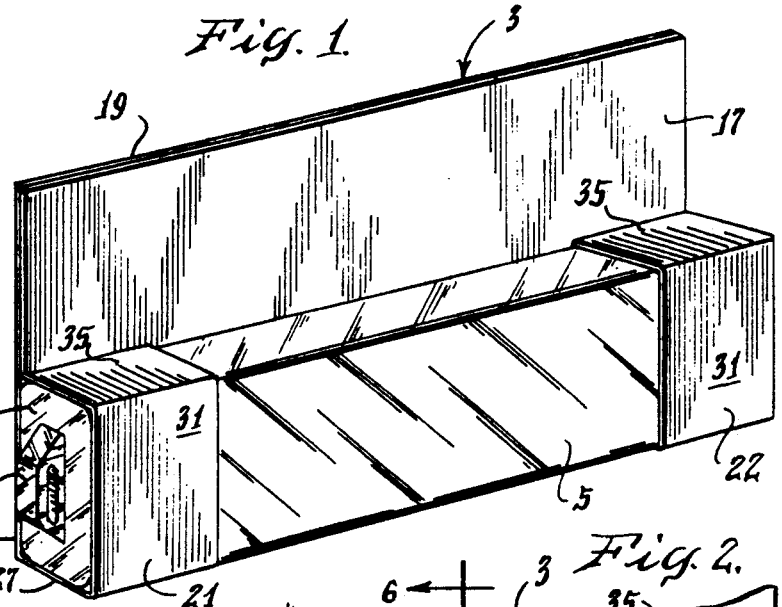
FIG. 1 is a perspective view of my combined retail package and carrying case.

A perspective view of my combined retail package and carrying case 1 is shown in FIG. 1. The combination is made up a cardboard retail display card 3 and a transparent permanent carrying case 5 showing the product, such as a curling iron.

Figure 2:
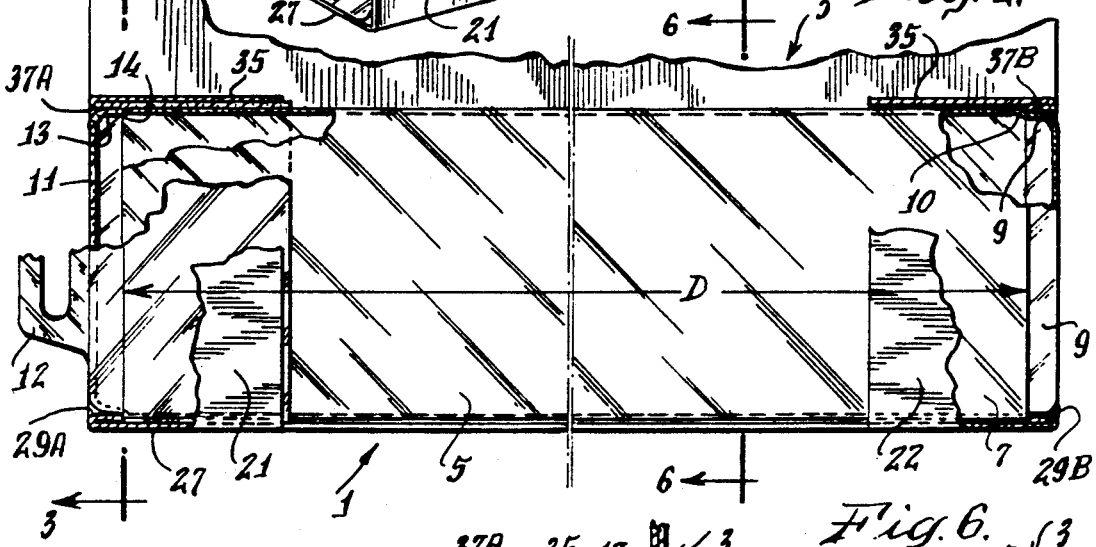
FIG. 2 is a front elevation, partially broken away in section.
Figure 3:
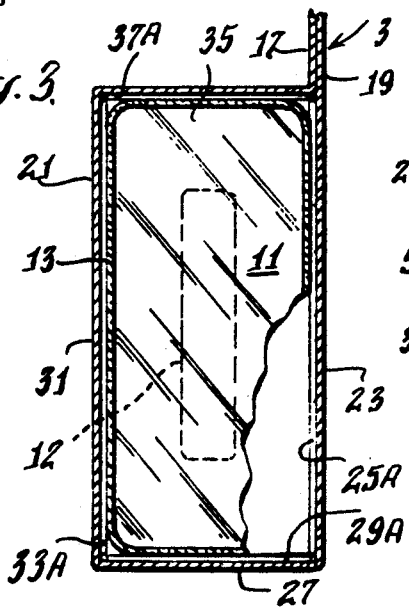
FIG. 3 is a section on line 3—3 of FIG. 2.

The carrying case 5 is formed of clear plastic, blow molded, and includes a base portion 9 and a top portion 11 with a handle 12 that slidingly fits over the top section of the base portion. For reasons to be described below, the base portion has a peripheral indentation 9, with inner edge 10, adjacent the bottom of the case, and the top portion has a peripheral indentation 13, with inner edge 14, adjacent the upper edge of the top. When the case is closed, the distance between the two indentations 9 and 13 is the distance "D", shown in FIG. 2.

The card 3 is formed of a folded and sealed piece of cardboard. It is formed such that it has a front sheet 17 (which can carry advertising copy) adhered to a rear sheet 19 with two case-engaging sleeves 21 and 22, one of which is at each side of the formed card. Sleeves 21 and 22 are shaped and dimensioned so as to fit about and hold case 5. Each of the sleeves have a rear portion 23, a bottom portion 27, a front portion 31, and a top portion 35.

The sleeves have opposing locking flanges inside their outer ends. Thus, sleeve 21 has internal flanges or collars 25A, 29A, 33A, and 37A at its outer end ; and sleeve 22 has internal flanges or collars 25B, 29B, 33B, and 37B at its outer end. These flanges extend inwardly a distance such that the distance between their internal edges is the same distance "D", or slightly less, as the distance "D" between the two indentations 9 and 13.

Figure 4:
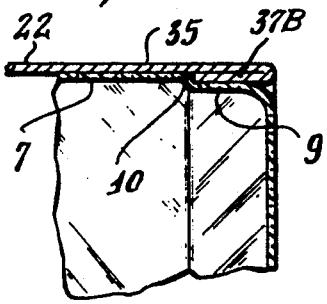
FIG. 4 is an enlarged portion of the upper right corner of FIG. 2 showing the interengagement of the inner flange of the sleeve with the indented periphery of the base of the carrying case.

Now, as can be seen, the internal flanges engage with the edges of the peripheral indentations of the case, and lock it in place. FIG. 4 shows the interlocking of locking flange 37B with the edge 10 of the peripheral indentation 9 on base portion 7. The other internal flanges 25B, 29B, and 33B interlock similarly with edge 10. The top 11 is locked in position in the same fashion; internal flanges 25A, 29A, 33A, and 39A interlock with edge 14 of peripheral indentation 13. The drawings show four locking flanges in each sleeve; but, if desired, fewer could be used.

It should be noted that the locking flanges in the sleeve at one end face the locking flanges in the sleeve at the other end, and the edges 10 and 14 face away from each other. Thus, the flanges and the edges oppose each other and interengage. The distance between the opposed locking flanges is greater than the distance between the sleeves.

Figure 5:
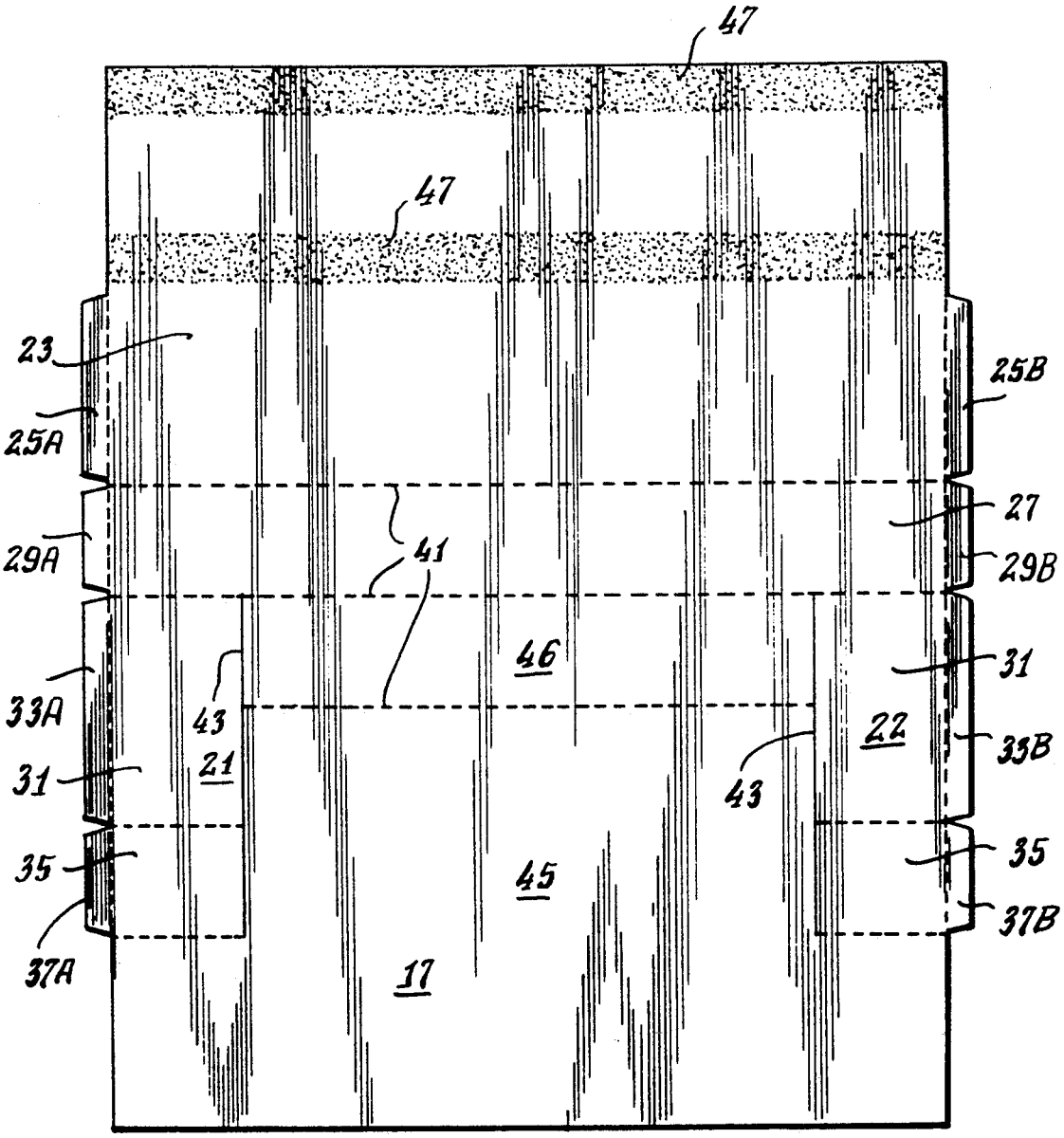
FIG. 5 is a plan view of the card used to make the package, before it has been folded and sealed.

FIG. 5 shows the card from which the retail package card is formed. The card is cut so as to form the inward flanges, 25A and B, 29A and B, 33A and B, and 37A and B, associated with sleeve portions 23, 27, 31, and 35, respectively. The flanges are folded inwardly on the dotted lines between them and the sleeve portions. The card is cut on lines 41 so that areas 45 and 46 can be reverse folded inwardly.

Figure 6:
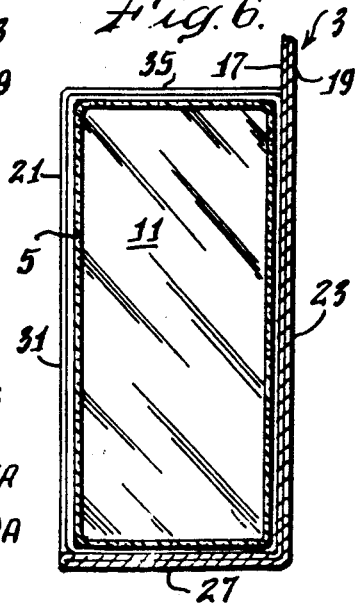
FIG. 6 is a transverse section, taken on line 6—6 of FIG. 2.

The card is then folded on the dotted lines so that the sleeve portions project outwardly, forming sleeves 21 and 22, and areas 45 and 46 are folded inwardly (FIG. 6) as front sheet 17 is folded up against rear sheet 19 and adhered to it by adhesive in areas 47. This, then, results in the retail package card as shown in FIG. 1.

The dimensions of the carrying case 5 relative to the sleeves 21 and 22 are such that the case can be slid into the sleeves 21 and 22 from one end, but will be locked in place by the flanges. Assuming the case is slid through sleeve 21 first and then sleeve 22, it can be seen that, as the case reaches the far end of the far sleeve 22, the flanges 25B, 29B, 33B, and 37B will abut against edge 10 of periphery 9 of base portion 7, preventing further movement in that direction. At the same time, flanges 25A, 29A, 33A, and 37A will snap into periphery 13 of top 11 and abut against edge 14. This is due to the spacing "D" between the flanges in the sleeves and between the edges 10 and 14 of the carrying case.

As a result, the respective sets of flanges and abutting edges will prevent movement of the case 5 in either direction. The case has been locked into the two sleeves and so is held integrally with the card 3; and one must almost destroy the sleeves in order to remove the case. This makes the combined package pilferproof; yet, at the same time, the package is durable and allows the product to be viewed.

I claim:

1. A retail display formed of a display card and a transparent carrying case, said carrying case being elongated and having peripheral indentations encompassing the periphery of said case along opposing ends of said case, said peripheral ends of said case, said display card including a pair of sleeves secured thereto, the periphery of said sleeves conforming in size and shape to the periphery of said carrying case, at least one locking member within each said sleeve, and each said locking member being positioned to oppose its respective said locking edge, whereby said locking edges and said locking members interengage and thereby secure said carrying case within said sleeves.

2. A retail display as set forth in claim 1 in which the distance between said locking edges is about the same as the distance between said locking members.

3. A retail display as set forth in claim 1 in which the cross-sectional shape and configuration of said sleeves conforms to the cross-sectional shape and configuration of said carrying case.

4. A retail display as set forth in claim 3 in which the said shapes are rectangular.

5. A retail display as set forth in claim 1 in which said locking members are inwardly-extending flanges.

6. A retail display as set forth in claim 1 in which said display card is formed of a single sheet of cardboard cut and folded to form a display area and said sleeves.

7. A retail display as set forth in claim 1 in which each said sleeve includes a plurality of said locking members.

8. A retail display as set forth in claim 1 in which said locking edges encompass the entire periphery of said carrying case.

9. A retail card for displaying a product in a transparent carrying case, said case having indented areas proximate its opposite ends and outwardly-facing locking edges therein, said card including a sheet of cardboard, said cardboard being cut and folded to define a front surface and a pair of sleeves secured to said front surface, each of said sleeves having at least one locking member therein, wherein the distance between said opposing locking members is greater than the distance between said sleeves, said locking members opposing each other, and said sleeves and said locking members being spaced and dimensioned so said sleeves fit about said carrying case and said locking members interfit with said locking edges, whereby said sleeves can grip and hold said carrying case.

10. A retail card as set forth in claim 9 in which said sleeves are generally rectangular in cross-section and include a said locking member on each inner surface thereof.

11. A retail card as set forth in claim 9 in which said locking members are inwardly-extending flanges formed from portions of said sheet.

12. A retail display formed of a display card and a transparent carrying case, said carrying case being elongated and having peripheral indentations along opposing ends of said case, said peripheral indentations having locking edges facing their respective ends of said case, said display card including a pair of sleeves secured thereto, the periphery of said sleeves conforming in size and shape to the periphery of said carrying case, a plurality of locking members in each said sleeve, and each said locking member being positioned to oppose its respective said locking edge, whereby said locking edges and said locking members interengage and thereby secure said carrying case within said sleeves.

13. A retail display formed of a display card and a transparent carrying case, said carrying case being elongated and having peripheral indentations along opposing ends of said case, said peripheral indentations having locking edges facing their respective ends of said case, said locking edges encompassing the entire periphery of said carrying case, said display card including a pair of sleeves secured thereto, the periphery of said sleeves conforming in size and shape to the periphery of said carrying case, at least one locking member in each said sleeve, and each said locking member being positioned to oppose its respective said locking edge, whereby said locking edges and said locking members interengage and thereby secure said carrying case within said sleeves.

* * * * *